US007967497B2

(12) United States Patent
Whitney

(10) Patent No.: US 7,967,497 B2
(45) Date of Patent: Jun. 28, 2011

(54) GEOMETRIC AND PERFORATED PAINT MIXER AND PAINT ROLLER CLEANER

(76) Inventor: Mike Whitney, Elk Creek, CA (US)

( * ) Notice: Subject to any disclaimer, the term of this patent is extended or adjusted under 35 U.S.C. 154(b) by 1104 days.

(21) Appl. No.: 11/737,315

(22) Filed: Apr. 19, 2007

(65) Prior Publication Data

US 2007/0183255 A1 Aug. 9, 2007

Related U.S. Application Data

(63) Continuation-in-part of application No. 10/923,677, filed on Aug. 24, 2004, now Pat. No. 7,229,206, which is a continuation-in-part of application No. 10/283,131, filed on Oct. 30, 2002, now abandoned.

(51) Int. Cl.
*B01F 7/20* (2006.01)

(52) U.S. Cl. ..... 366/129; 366/308; 366/605

(58) Field of Classification Search ..... 366/129, 366/285, 308, 325.93, 605
See application file for complete search history.

(56) References Cited

U.S. PATENT DOCUMENTS

| | | | | |
|---|---|---|---|---|
| 385,151 | A | | 6/1888 | Thompson |
| 820,405 | A | | 5/1906 | Dunlap |
| 1,841,435 | A | | 8/1929 | Gibson |
| 2,181,078 | A | * | 11/1939 | Dehuff ..... 366/309 |
| 2,896,925 | A | | 4/1955 | Place |
| 2,799,485 | A | | 7/1957 | Silverman |
| 2,931,661 | A | | 4/1960 | Harris |
| 3,154,123 | A | * | 10/1964 | Tomlinson ..... 241/101.6 |
| 3,460,268 | A | | 8/1969 | Greathouse |
| 3,925,908 | A | | 12/1975 | Dunn |
| 4,054,272 | A | | 10/1977 | Cooke |
| 4,545,395 | A | | 10/1985 | Kolb |
| 5,073,033 | A | | 12/1991 | Klepeis |
| 5,183,336 | A | | 2/1993 | Poltorak et al. |
| 5,984,518 | A | | 11/1999 | King et al. |
| 6,012,473 | A | | 1/2000 | Koyama |
| 6,520,672 | B1 | * | 2/2003 | Whitney ..... 366/129 |
| 7,229,206 | B2 | * | 6/2007 | Whitney ..... 366/129 |

* cited by examiner

*Primary Examiner* — David L Sorkin
(74) *Attorney, Agent, or Firm* — Cantor Colburn LLP

(57) ABSTRACT

The present invention sets forth an implement which enables the user to mix paint, and optionally to perform several other painting related functions. The implement has a perforated paddle with oppositely deflected upper portions to enhance mixing of the paint. The implement may be selectively positionable to either mix paint or to support a paint roller for cleaning. A paint can remover and a paint can rim cleaning device are also incorporated into the implement. A single implement can serve the functions of opening paint cans, stirring paint in a container, cleaning the groove around the lip of a paint can, cleaning a paint roller, and as a spatula to aid in removing paint from a can.

18 Claims, 14 Drawing Sheets

GEOMETRIC AND PERFORATED PAINT MIXER AND PAINT ROLLER CLEANER

REFERENCE TO RELATED APPLICATION

This is a Continuation-in-Part of Ser. No. 10/923,677, filed Aug. 24, 2004, now U.S. Pat. No. 7,229,206; which is a Continuation-in-Part of Ser. No. 10/283,131, filed Oct. 30, 2002, now abandoned.

BACKGROUND OF THE INVENTION

1. Field of the Invention

The present invention relates to painting accessories, and more particularly to a painting implement that assists in diverse operations of hand painting, such as opening the can, mixing and stirring paint solutions, as well as aiding in cleaning the used paint roller, can and can lip.

2. Description of the Prior Art

Painting by hand, particularly building walls and partitions and other large objects, requires different tools such as brushes and rollers for applying paint to surfaces being painted. When a painter interrupts his or her work for any reason, it is a wise precaution to clean brushes and rollers so that paint will not dry and cake thereon. Frequently this is done by wiping brushes and even rollers on a convenient surface, such as the inner flange of a paint can. However, merely wiping leaves a considerable amount of paint on the brush or roller.

The prior art has taken note of the problem of efficient cleaning paint supplies, and has proposed apparatuses to expedite cleaning. The prior art as seen in U.S. Pat. No. 3,925,908 (issued to Kirkley J. Dunn on Dec. 16, 1975); U.S. Pat. No. 6,012,473 (issued to Takehiko Koyama on Jan. 11, 2000); U.S. Pat. No. 3,460,268 (issued to Carl F. Greathouse on Aug. 12, 1969); U.S. Pat. No. 4,545,395 (issued to Kolb on Oct. 8, 1985); U.S. Pat. No. 5,984,518 (issued to King et al. on Nov. 16, 1999); and U.S. Pat. No. 2,931,661, (issued to Joseph N. Harris on Apr. 5, 1960) as cited in the previous parent application Ser. No. 09/621,079 and Ser. No. 10/283,131 are all incorporated herein as reference.

The prior art is replete with devices designed to address the problems of adequate paint mixing as shown in the references to Cooke (U.S. Pat. No. 4,054,272), Silverman (U.S. Pat. No. 2,799,485), Gibson (U.S. Pat. No. 1,841,435); and Place (U.S. Pat. No. 2,896,925). These prior art patents provide a variety of means of mixing paint solutions, however none of these devices may also be used during the painting process as a paint roller cleaner in addition to a paint solution mixer.

None of the above listed inventions and patents, taken either singly or in combination, is seen to describe the instant invention as claimed.

SUMMARY OF THE INVENTION

The present invention sets forth a painting implement which enables the user to open paint cans, mix paint and clean conventional paint rollers utilizing a hand drill, as well as clean the paint can lip of accumulated paint. In most embodiments, the painting implement is selectively adjustable to be configured to mix paint or to support a paint roller for cleaning, thereby being capable of providing several functions. Implements of different sizes may be provided, for cleaning and using an assortment of sizes of paint rollers. The implement is provided with a paddle member that is perforated and of a geometric non-planar form to enhance mixing, with most embodiments of the paddle having a paint can opener tab and a can lip cleaning tab. The paddle functions as a spatula to remove paint from a container in which it is held. This function is enhanced by the shape of the paddle, specifically by deflection of the upper corners of the paddle which helps to push the paint up and over the lip of the paint container. Optionally, the paddle's upper edge is convexly curved such that the paddle is wider at the middle than at the edges, to better retain a paint roller thereon for cleaning. Optionally, the corners of the paddle may have a generally spherical surface that minimizes potential scraping of a paint bucket by the paddle.

It is therefore an object of the invention to provide an implement for painting that performs several painting related functions including can opening, paint mixing, roller cleaning, paint can lip cleaning.

It is another object of the invention that the implement engage a hand drill for imparting rotation for paint mixing and cleaning of paint rollers.

It is a further object of the invention that the implement engage paint rollers of different dimensions, thereby cooperating with standard painting tools.

It is an object of the invention to provide a painting implement for the purposes described which is inexpensive, dependable and fully effective in accomplishing its intended purposes.

It is a further object of the invention to provide a painting implement that assumes two different functional positions with ease.

It is a further object of the invention to provide an embodiment of a painting implement that has a paddle mounted in fixed relation to a shaft, for use in larger containers or to mix thicker substances.

It is an object of the invention to provide a painting implement that is effective but simple in design resulting in lower manufacturing costs.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1A:
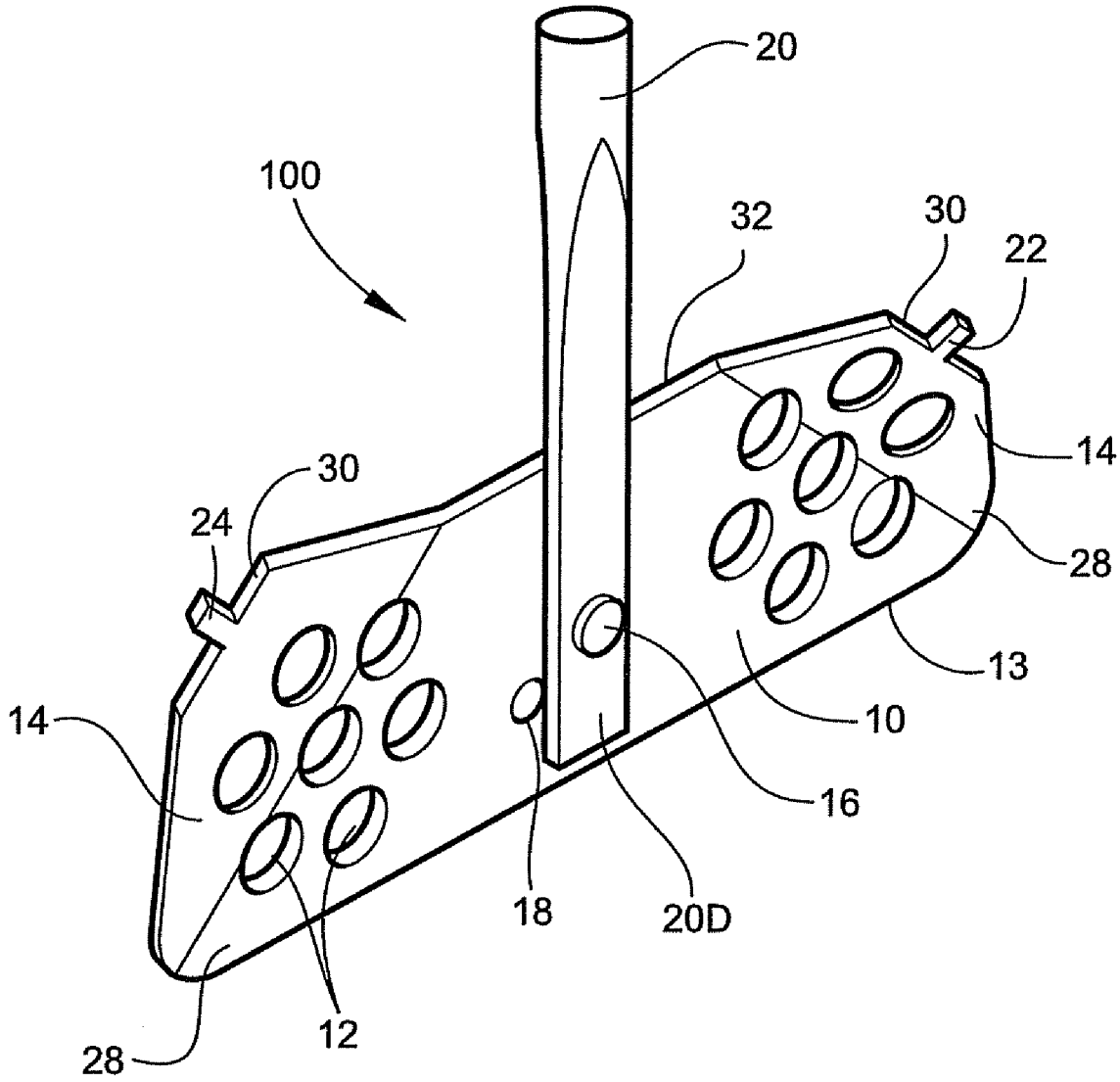
FIG. 1A is a perspective view of a first embodiment of the inventive painting implement in a first position.
Figure 1B:
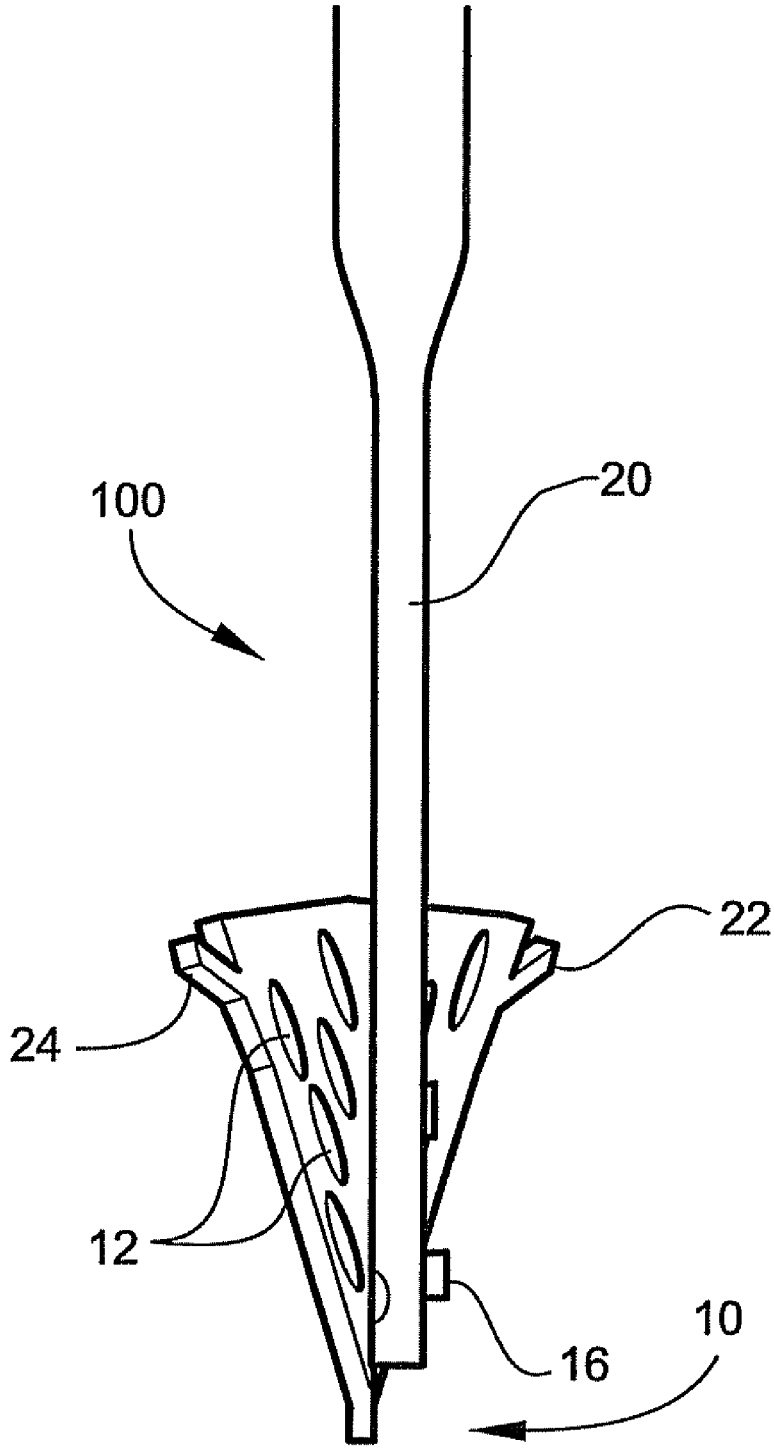
FIG. 1B is a side view of a first embodiment of the inventive painting implement in a first position.
Figure 1C:
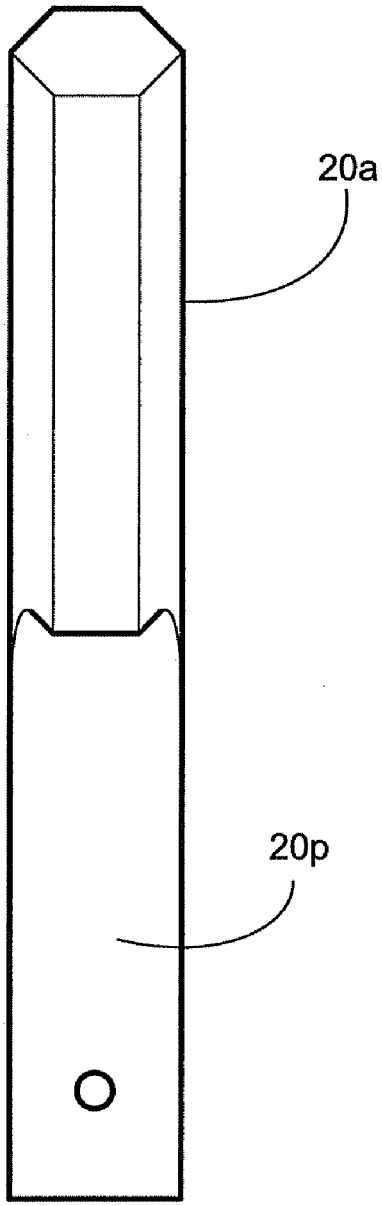
FIG. 1C is a front view of an alternative shape for the rod shaft.
Figure 1D:
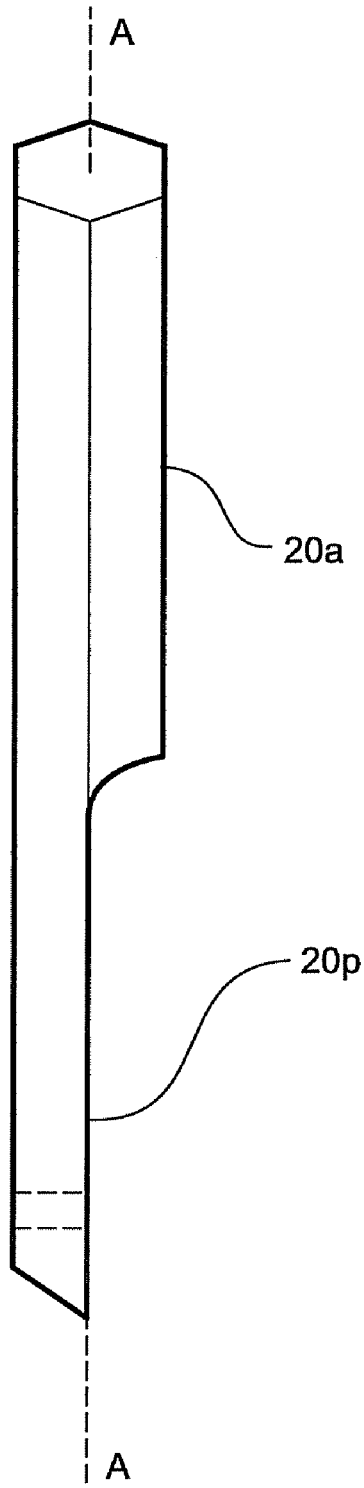
FIG. 1D is a side view of the alternative shape for the rod shaft shown in FIG. 1C.

FIGS. 1A and 1B show a first embodiment of the inventive, geometrically shaped painting implement 100. As can be seen, the inventive painting implement 100 has a paddle member 10, having a length, height and thickness, and ideally having slightly rounded lower corners 28 adapted to lessen the severity of any impacts between the corners of the paddle member and a container in which it is being used. The lower edge 13 of the paddle member 10 is flat to serve as a spatula to aid in the removal of paint from a paint can. The paddle member 10 is attached to a distal end 20D of a rod shaft 20, preferably at the center of the paddle member 10, by a pivoting fastener 16. The fastener 16 may comprise any suitable means of connection, such as a rivet, bolt and nut, etc., which allows selective rotational movement of the paddle member 10 around a pivot point located where the fastener 16 traverses the rod shaft 20, the rotational movement allowing the paddle member 10 to move between two positions, discussed further below. In this embodiment, the rod shaft 20 is cylindrical, transitioning to flattened, opposing faces at the distal end 20D, thereby providing a flat interface between the rod shaft 20 and the face of the paddle member 10, as best seen in perspective view in FIG. 1A and in side view in FIG. 1B. In an alternative embodiment, as seen in FIGS. 1C and 1D, the rod shaft 20*a* has a hexagonal cross-section along a majority of its length, with approximately one half of its cross section cut away near a distal, paddle-supporting end to provide a planar surface 20*p* against which the paddle member 10 can be mounted, which positions the paddle member 10 substantially along the longitudinal axis A-A of the rod shaft 20*a*, thereby providing improved balance of the implement, which is particularly important during rapid rotation during use. While not shown, it is understood that any other polygonal cross-sectional shape of the shaft can be used and still fall within the scope of the invention.

A plurality of apertures 12 are formed through the paddle member 10, thereby allowing a viscous fluid (hereinafter referred to as paint, although it would be evident to one of ordinary skill in the art that the implement 100 could be used for stirring other viscous fluids, such as drywall mud or spackling) being stirred to pass therethrough, increasing the agitation rate of the paint. The apertures 12 may all be formed such that they pass through the thickness of the paddle member 10 at a right angle with respect to the planar surfaces of the surface of the portion of the paddle member 10 through which they pass, or the apertures 12 may be formed at differing angles from one another with respect to the planar surfaces of the portion of the paddle member 10 through they pass, further aiding in more thorough mixing. The apertures 12 on a paddle member 10 may all be of the same size, or they may be provided in a variety of sizes on the same paddle member 10 to aid in the mixing of the paint. Provision of apertures of varied sizes is particularly desirable when mixing thicker materials, such as drywall mud, thinset, or grout. The larger apertures allow the implement to move through the thicker, perhaps clumpier, material while reducing strain on the motor of the rotary device used to drive the implement. As the clumps are broken up, or the material is made thinner due to being mixed, the substance can flow through the smaller apertures on the paddle to provide finer mixing of the substance. Additionally, the apertures 12 may be substantially uniformly arranged on the paddle member 10 or they may be arranged in a different pattern, as desired to provide a particular effect in the mixing of the paint.

Additionally, a portion of each end of the paddle member 10 is deflected from the plane in which the rest of the paddle member 10 lies. The line of each of the two deflections 14 typically extends from a lower corner 28 of paddle element 10 to a point between the corresponding upper corner 30 and a midpoint between the two upper corners 30. The two deflections 14 extend, respectively, to opposite sides of the plane of the paddle member 10 from one another, such that as the paddle member 10 rotates around the rod shaft 20 in a clockwise rotation, each of the two deflections 14 precedes the plane of the paddle member 10, thereby aiding in cutting into the paint as the paddle member 10 rotates, creating a wave action in the paint as it is stirred. It would be evident to one of ordinary skill in the art that the exact shape of the deflections 14 could vary without departing significantly from the spirit of the present invention.

Figure 2A:
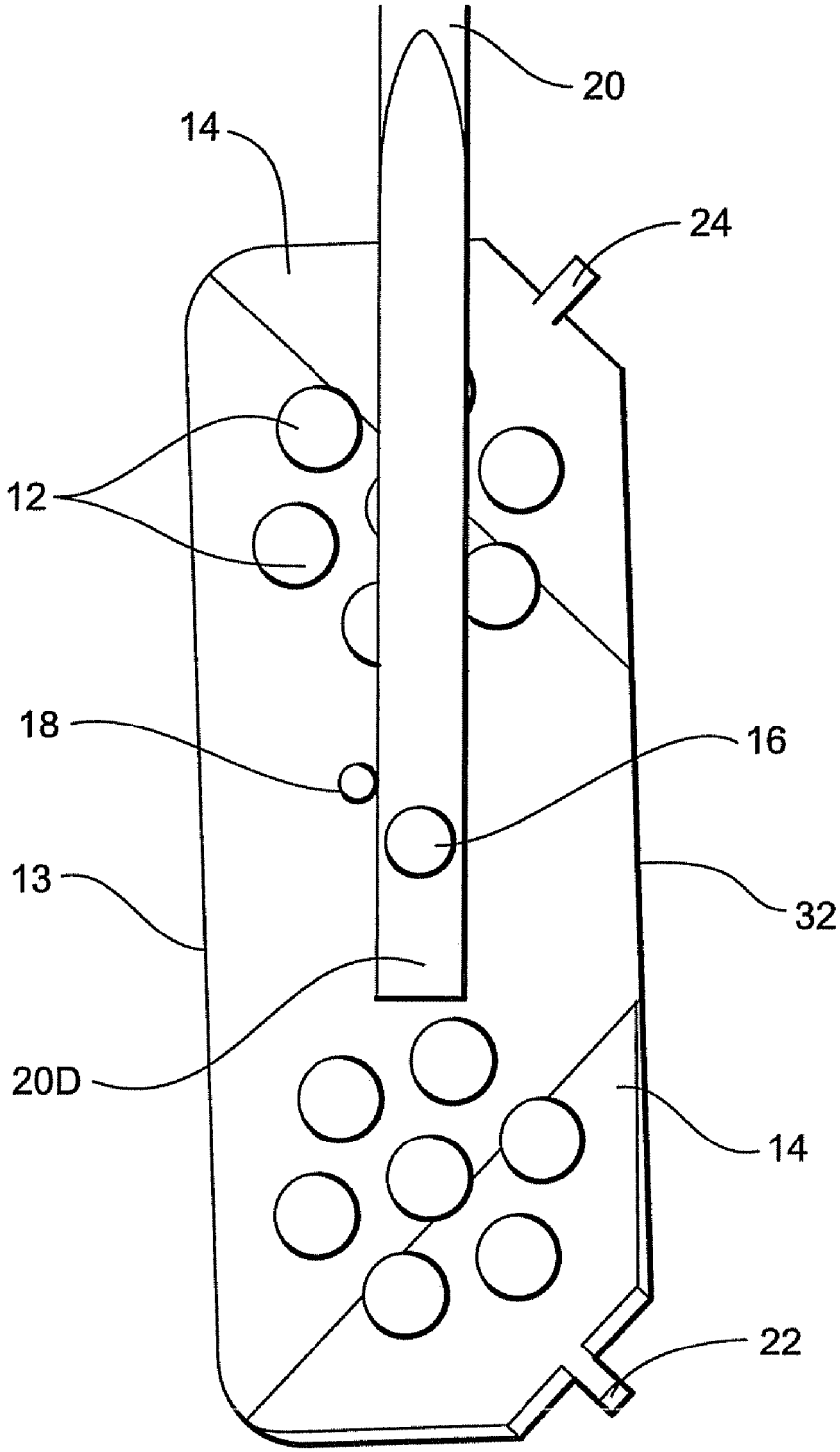
FIG. 2A is a front view of a first embodiment of the inventive painting implement in a second position.

In embodiments of the painting implement of the present invention having a paddle member 10 that can be rotated relative to the shaft 20, it is desirable to limit the rotation of the paddle member 10 so that it can be releasably placed in a first, paint stirring position where the lower edge 13 of the paddle member 10 is substantially perpendicular to a longitudinal axis of the shaft 20, as shown in FIG. 1A, and alternately releasably placed in a second, roller-supporting position where the lower edge 13 of the paddle member 10 forms an acute angle with the longitudinal axis of the shaft 20, as shown in FIG. 2A. A variety of different structural elements can be provided to limit the rotation of the paddle member 10 relative to the shaft 20.

As seen in FIG. 1A, a stop nub 18 extends outwardly from the surface of paddle member 10 to one side of shaft rod 20, at a point proximate the distal end 20D of shaft rod 20, below the pivoting fastener 16. The stop nub 18 limits the rotation of the paddle member 10 about the pivoting fastener 16 to an arc, typically less than 90°, by interfering with the shaft rod 20 at opposite ends of a rotational arc of the paddle member 10, such that paddle member 10 may rotate between a position that is substantially normal to shaft rod 20 or substantially parallel to shaft rod 20, although preferably at a slight angle from truly parallel, as will be further detailed below. Stop nub 18 may have rounded shoulders which would allow a user to vary the tightness of the connection between the stop nub 18 and the rod shaft 20 by twisting the paddle to varying degrees, thereby affecting whether or not, and how much, stop nub 18 passes under the rod shaft.

Figure 2B:
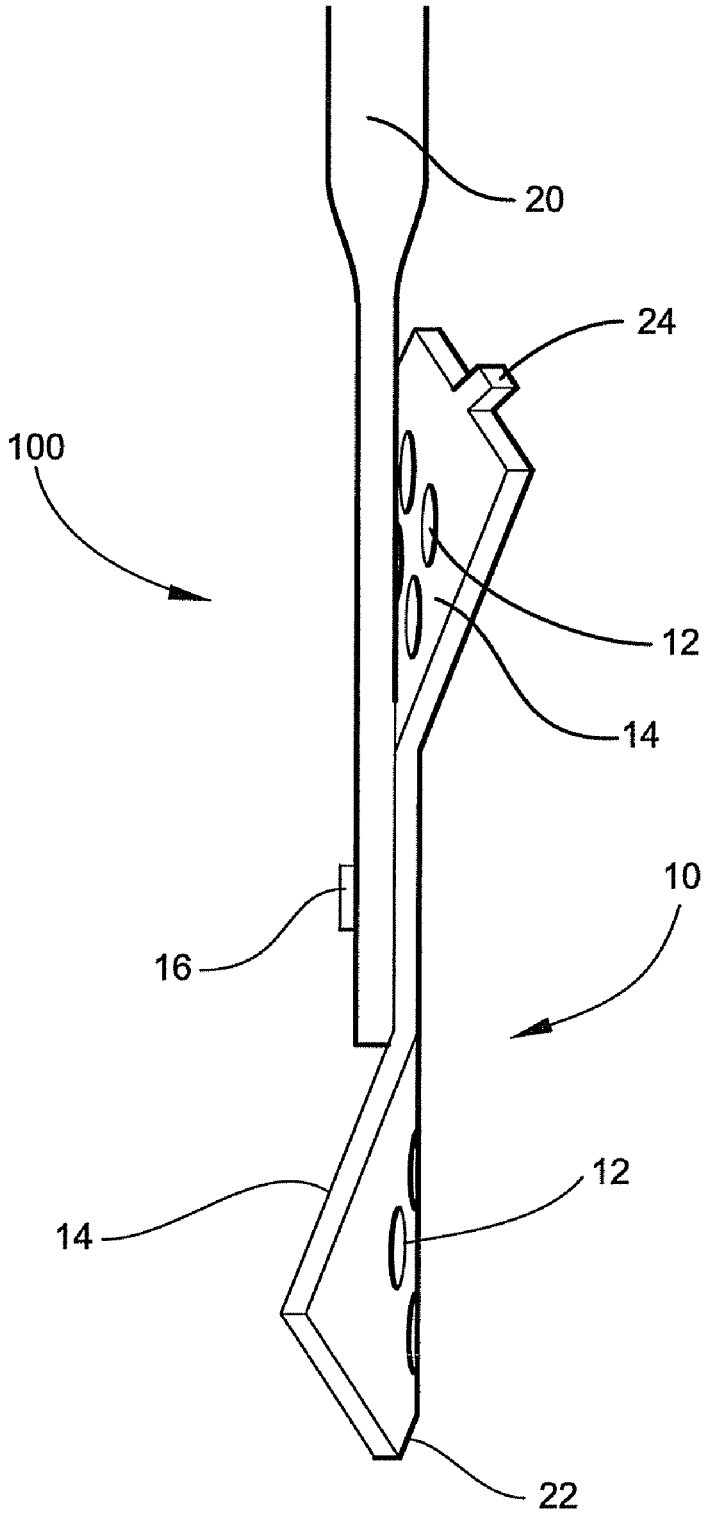
FIG. 2B is a side view of a first embodiment of the inventive painting implement in a second position.
Figure 2C:
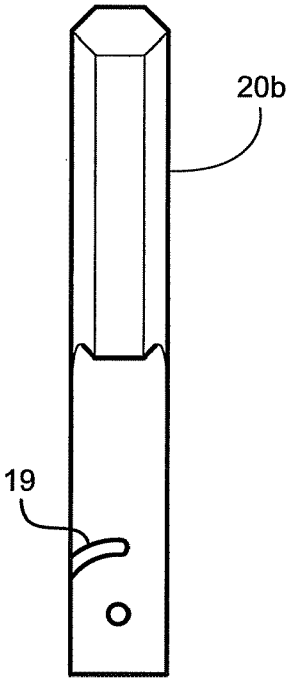
FIG. 2C is a front view of a shaft with an alternative rotation limiting mechanism.
Figure 2D:
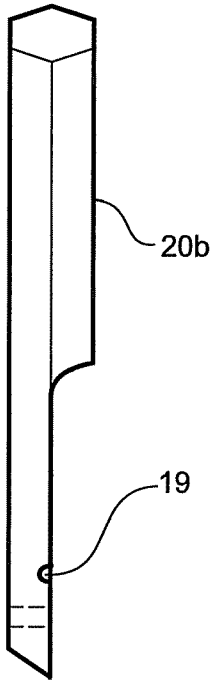
FIG. 2D is a side view of a shaft with the alternative rotation limiting mechanism of FIG. 2C.

While in the embodiment of FIGS. 1A-1B and 2A-2B, the stop nub 18 is stopped from further movement by bumping up against the edge of shaft rod 20, in an alternative embodiment shown in FIGS. 2C and 2D, an arcuate channel 19 can be cut into one side of the shaft rod 20*b* so that during rotation of the paddle member 10, stop nub 18 is received within the channel 19 and rotation of the paddle is stopped by stop nub 18 reaching the end of channel 19. Channel 19 can be tapered from a larger open end to a smaller closed end in order to reduce wear on stop nub 18.

An additional structural feature that serves to limit the rotation of the paddle relative to the shaft is the interference, during rotation, of one of the deflections of the paddle with the shaft. This structural feature can function alone to limit rotation, or can be used in combination with any of the other rotation limiting structure disclosed herein. The interference of the deflection of the paddle with the shaft, in addition to stopping further rotation, additionally serves to releasably retain the paddle in the second, roller supporting position.

Figure 2G:
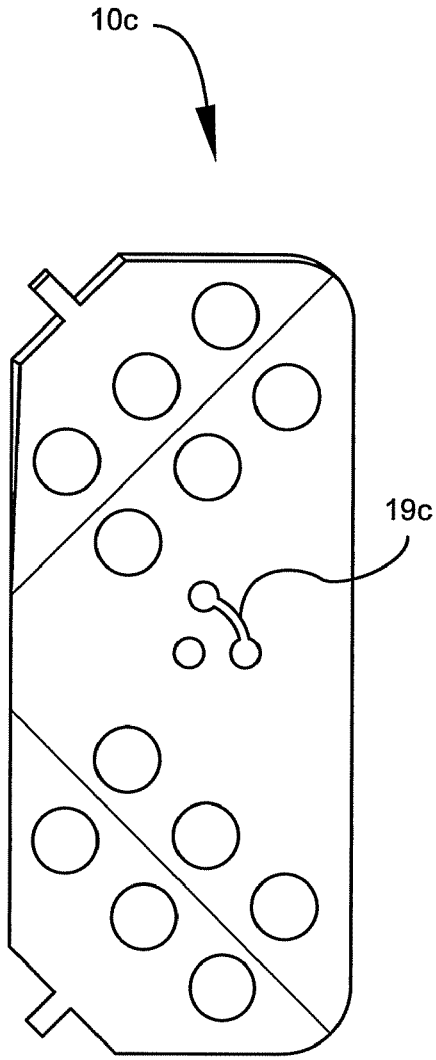
FIG. 2G is a front view of a paddle member with an alternative rotation limiting mechanism for use with the shaft of FIGS. 2E and 2F.
Figure 2E:
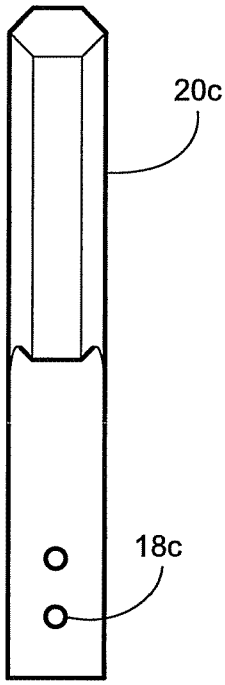
FIG. 2E is a front view of a shaft with another alternative rotation limiting mechanism.
Figure 2F:
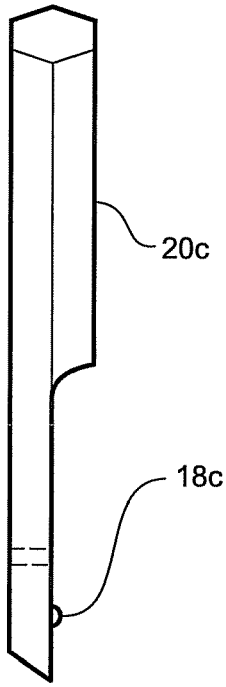
FIG. 2F is a side view of a shaft with an alternative rotation limiting mechanism of FIG. 2E.

In a further embodiment, shown in FIGS. 2E, 2F, and 2G, an additional variation of the stopping mechanism reverses the parts of the previous embodiment to provide a stop nub 18*c* on the shaft 20*c* which is received within an arcuate channel 19*c* formed on the surface of the paddle member 10*c*. Rotational movement of the paddle member 10*c* relative to rod shaft 20*c* is limited when stop nub 18*c* hits the end of travel within channel 19*c*.

In most embodiments, the upper corners 30 of the paddle member 10 are cut on a diagonal, as opposed to the rounded lower corners 28. Extending from a first of the diagonal upper corners is a substantially rectilinear paint can opener 22 protrusion dimensioned and configured to fit under the rim of a paint can lid (not shown) to pry it open. The can opener protrusion 22 may extend at a slight angle from the plane of the deflection 14. Extending from the second of the diagonal upper corners is a second substantially rectilinear lip cleaner 24 protrusion dimensioned and configured to fit within the rim lip (not shown) of a paint can to aid in the removal of paint accumulated in the rim lip (not shown).

Figure 3:
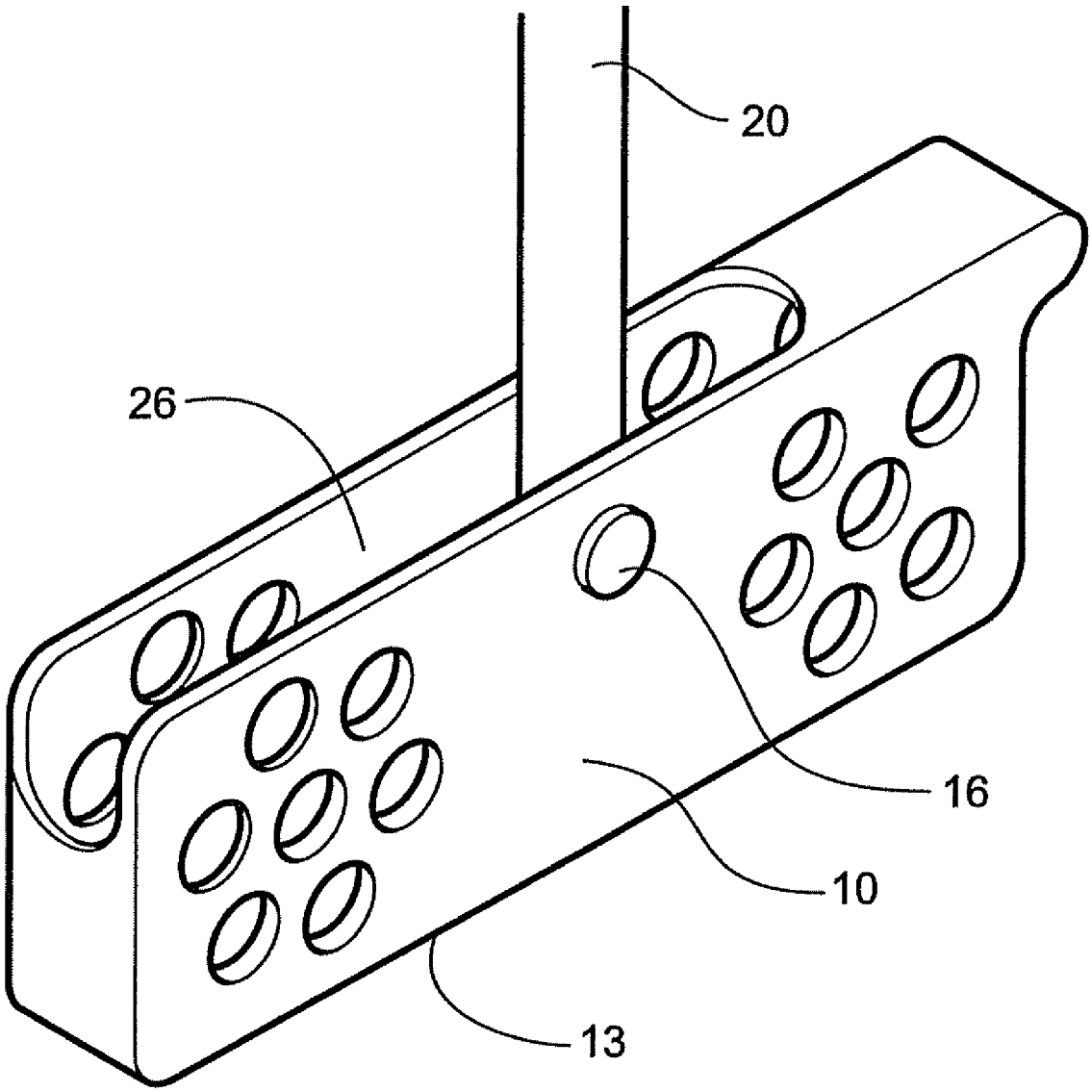
FIG. 3 is a perspective view of a second embodiment of the painting implement of the present invention having a shaft receiving groove formed therein.

In an alternative embodiment, rather than shaft rod 20 being attached to the paddle member 10 on one side of paddle member 10, paddle member 10 can be formed with a groove 26 along the upper edge thereof (FIG. 3), the end of rod shaft 20 being rotatably affixed therein by a pivot fastener 16 such that as the paddle member 10 is rotated about the pivot fastener 16 to the substantially parallel position, the rod shaft 20 fits into the groove 22, the walls of the groove 26 acting in lieu of the stop nub 18.

Figure 4A:
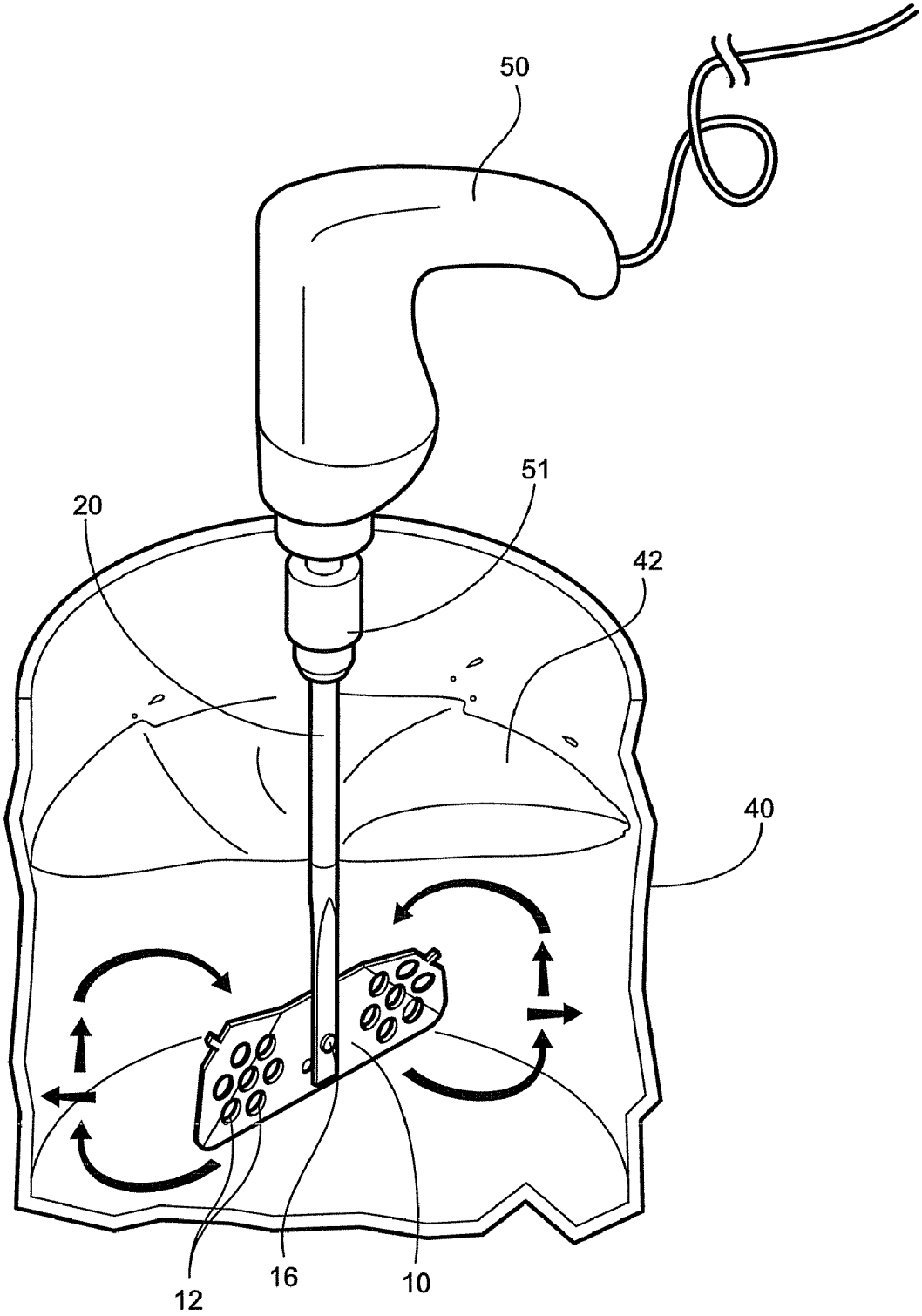
FIG. 4A is a perspective view of the painting implement of the present invention stirring paint in a wide container.
Figure 4B:
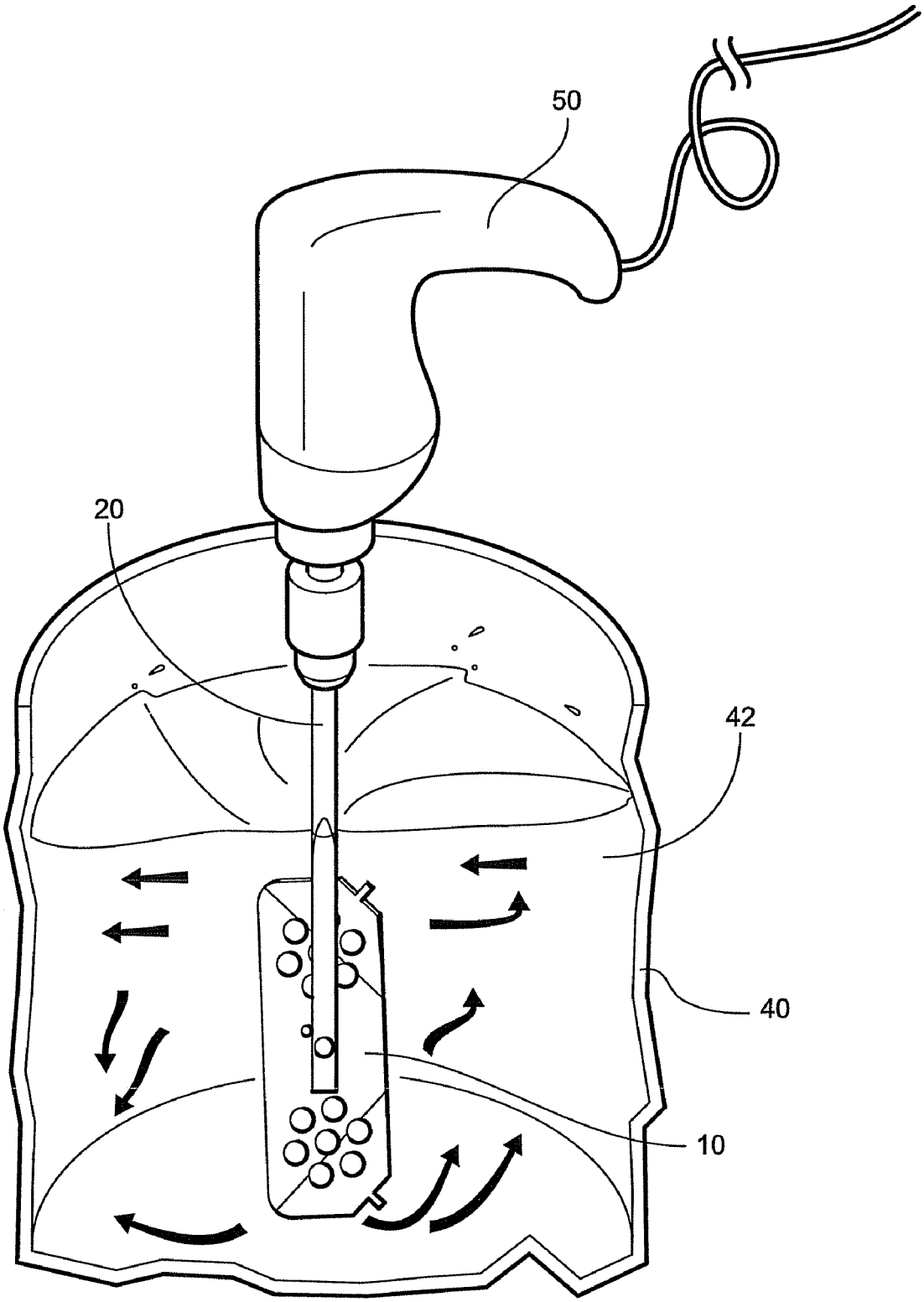
FIG. 4B is a perspective view of the painting implement of the present invention stirring paint in a narrow container.
Figure 6:
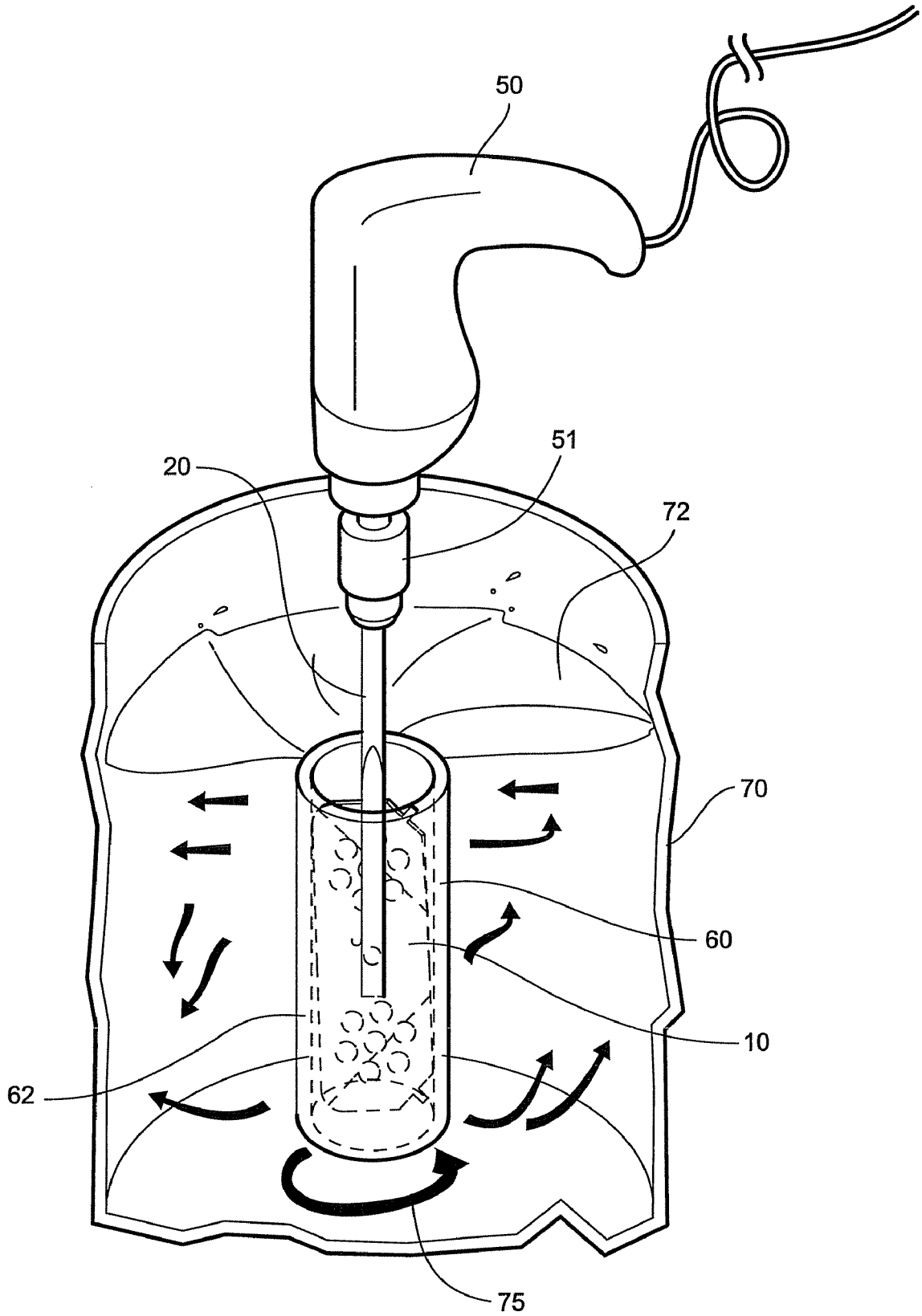
FIG. 6 is a perspective view of the painting implement in use cleaning a paint roller in a wide container filled with solvent.

As stated, in most embodiments of the invention, the inventive painting implement 100 may be set at two functionally distinct positions depending on the operation being performed with paddle member 10. FIGS. 1A and 1B illustrate the first, lateral or normal position, which is employed when the implement 100 is used as a mixer/stirrer in larger paint containers (typically 1 gallon and larger). As shown in FIGS. 4A, 4B and 6, the rod shaft 20 is an elongated, rigid shaft for coupling the paddle member 10 to an electrically operated hand drill 50. It would be evident to one of ordinary skill in the art that the shaft 20 could be grasped in the hand and the implement used as a hand-held stirring device without departing from the spirit of the present invention.

FIGS. 2A and 2B illustrate the painting implement 100 in a second, substantially linear or parallel position wherein the paddle member 10 is positioned substantially parallel to, but with an offset of an acute angle with respect to the rod shaft 20 (described further below). In this second position, the implement 100 functions as an element for mixing/stirring in a smaller container (typically 1 gallon or 1 quart), mixing/stirring thinner fluids in order to prevent excessive splashing which could be caused by using the first position, or for supporting a paint roller for cleaning (described below).

FIGS. 4A & 4B show the implement 100 in use stirring paint 42 within a paint container 40. The arrows indicate movement currents of the paint 42 as it is being mixed. The perforations 12 within paddle member 10, in conjunction with the deflections 14 of paddle member 10, both play a major part in further assisting with the mixing (i.e., stirring motion) of the paint 42 when the paddle is in motion. Additionally, paint may be stirred in a larger, unopened container by inserting the paddle member 10 through the bung hole (not shown) of the lid (not shown) of the container with the paddle in the second, linear position. Centrifugal force may cause the paddle member 10 to open to the lateral position of FIG. 1A, or it may be used in the linear position.

Figure 5:
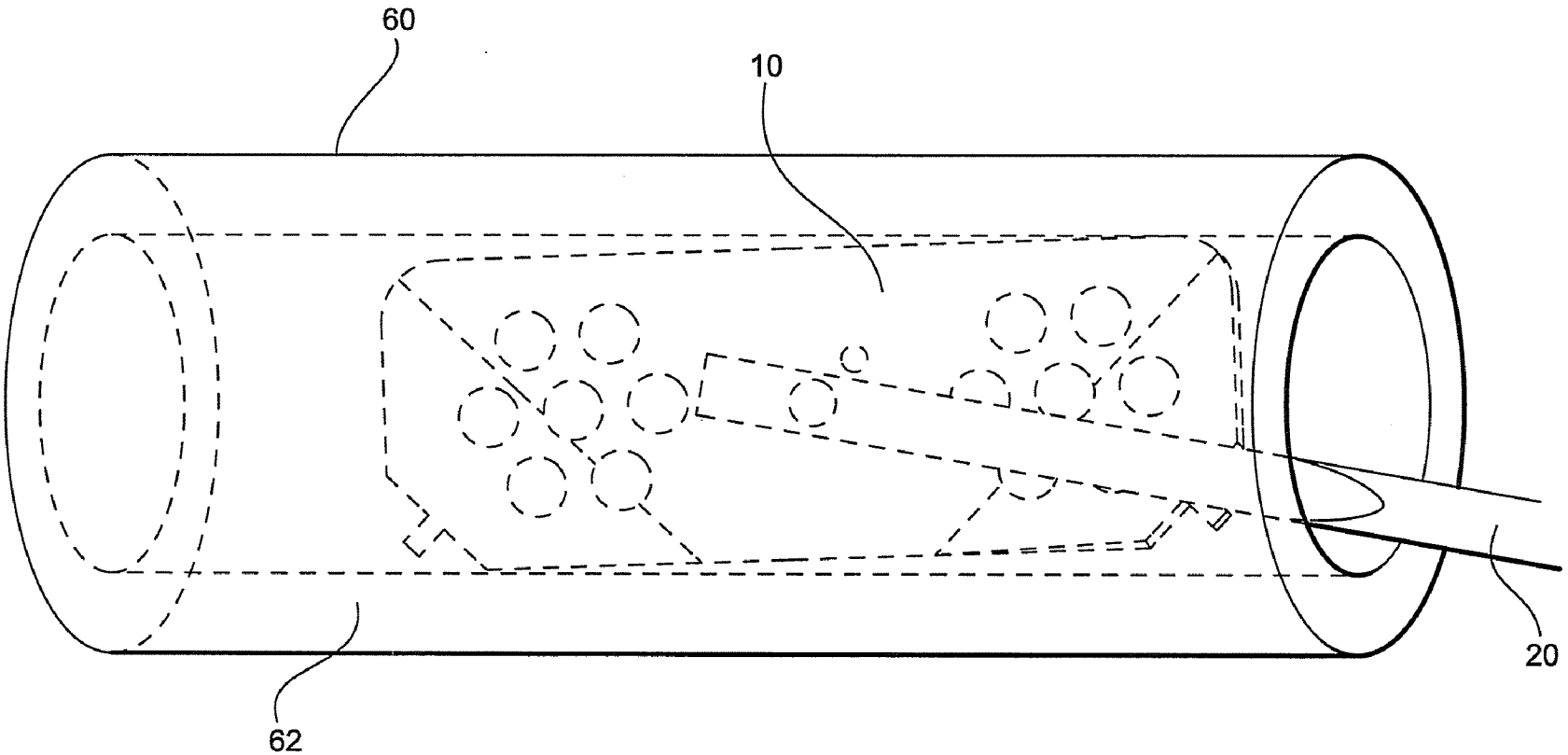
FIG. 5 is a perspective view of the painting implement of the present invention with a paint roller installed thereon.

Additionally, this second position may also be employed to assist with the cleaning of a paint roller 60, as shown at FIGS. 5 and 6. For the purpose of cleaning the roller 60, the paddle member 10 is inserted into the interior wall 62 of paint roller 60, in the linear configuration of FIGS. 2A and 2B, with the slight deviation from the rod shaft 20 allowing the paddle member 10 and the rod shaft 20 to engage the interior of the paint roller 60 to frictionally hold the paint roller 60 on the implement 100. As shown in FIG. 6, paint roller 60 may be inserted in a container 70 containing a cleaning solution 72. A hand drill 50 coupled to the paddle member 10 (by way of a proximal end of shaft 20) spins the roller 60, as indicated by arrow 75. The centrifugal forces produced by the offset shape of the paddle member 10 during the spinning aids in the removal of paint embedded within the fibers of roller 60 by producing a whipping action. This oscillation greatly enhances the cleaning process.

Figure 6A:
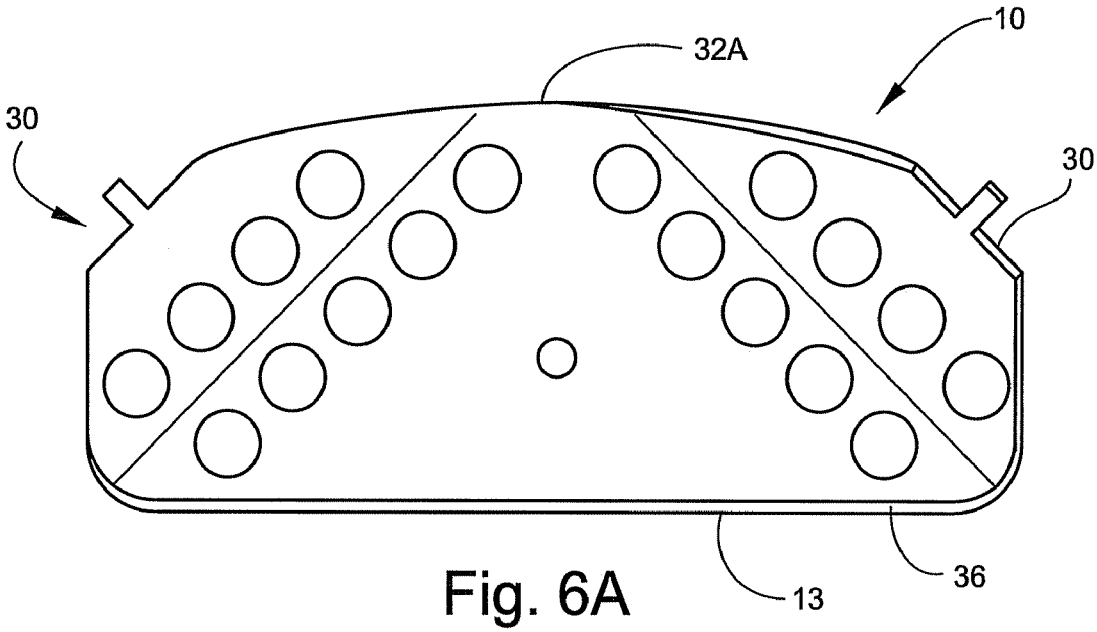
FIG. 6A is a front view of an alternative paddle shape.

While the portion of the upper edge 32 of paddle member 10 between the two angle-cut upper corners 30 can be seen in FIG. 2A to be a flat edge, parallel to lower edge 13, FIG. 6A shows an alternative embodiment where the portion of the upper edge 32*a* of paddle member 10 between the two angle-cut upper corners 30 is convexly curved such that the paddle is wider at the middle than at the edges, to better retain a paint roller thereon for cleaning.

In addition to being cleaned in a container, the paint roller 60 may be sprayed with a fluid from a nozzle head (not shown) as the hand drill 50 rotates the element 100 and paint roller 60.

The present invention is susceptible to variations and modifications which may be introduced thereto without departing from the inventive concept. For example, paddle member 10 may be removable from rod shaft 20, rather than having a rivet at pivot fastener 16. Instead, paddle member 10 could be retained by friction in the two operative positions, if desired. Additionally, the size of the paddle member 10 may vary so that it may be usable with paint rollers 60 of different dimensions. The paddle member 10 may have edges formed in a beveled manner, as well, to facilitate other uses of the paddle 10, such as scraping the interior of paint cans, etc. Furthermore, while a rigid paddle member 10 is preferred, a flexible paddle member 10 may also be utilized, allowing for more flexibility as a spatula for removing paint from a can.

Figure 7:
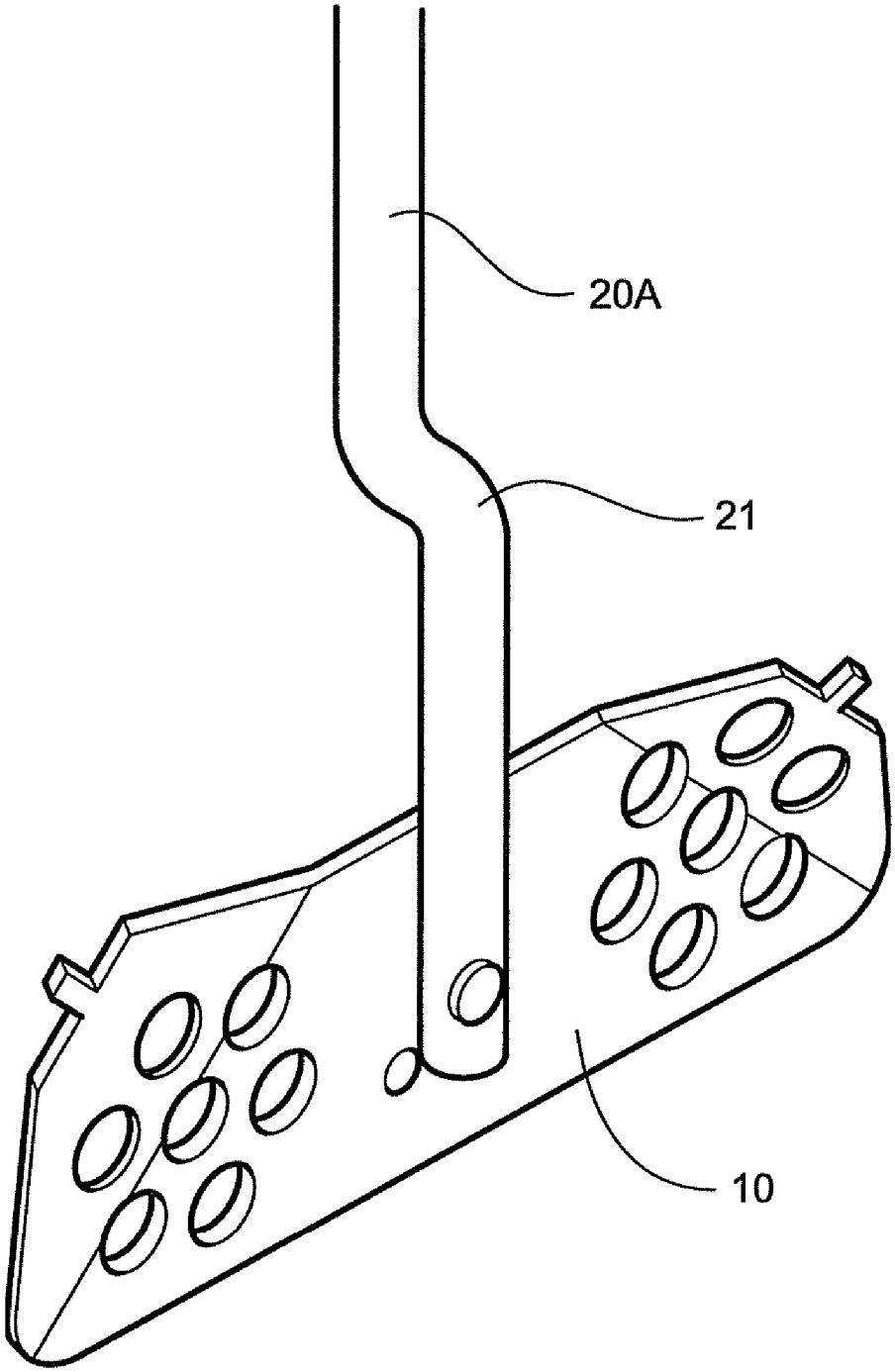
FIG. 7 is a front view of an additional embodiment of the painting implement of the present invention having a shaft with an axially offset distal portion.

In alternative embodiments, the rod shaft 20A may have an offset 21 along its length (FIG. 7), proximate the proximal end 20*p*. The paddle member 10 is mounted within the offset 21, which aids in maintaining a center of balance for the implement 100 which lies more along the axis of the shaft 20A, thereby reducing any wobble which would be caused by the blade 10 being attached to one side of the shaft.

Figure 8:
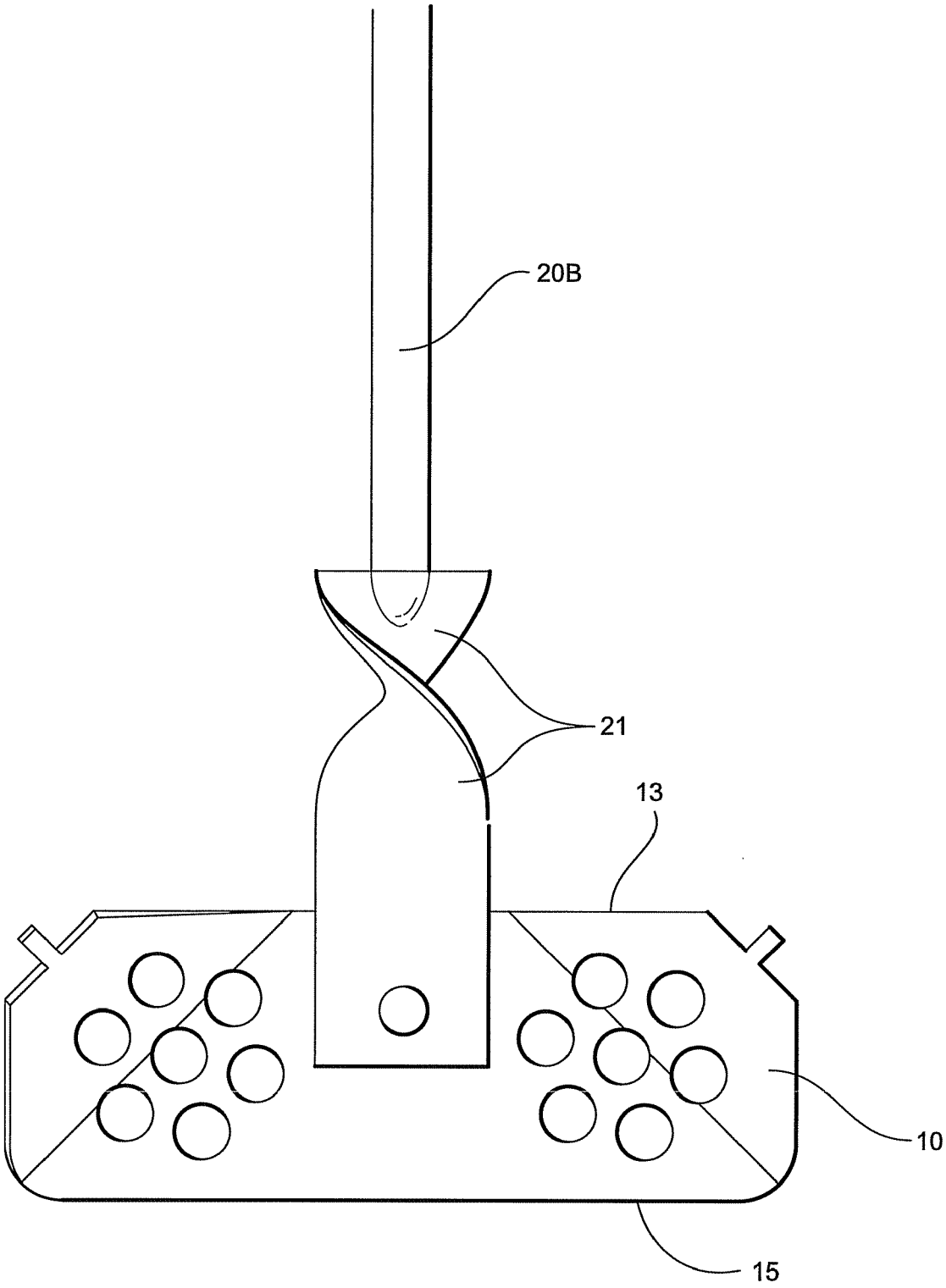
FIG. 8 is a perspective view of an additional embodiment of the painting implement wherein a distal portion of the shaft has a broad shaft paddle.

At FIG. 8, the rod shaft 20B may have a broad shaft paddle 21 formed therein. The shaft paddle 21 may either have a twist, as shown, or be flat (not shown). The shaft paddle 21 increases the agitation of the paint 42 beyond that of the paddle member 10. Additionally, the upper 13 and lower 15 edges of the paddle member 10 may be more flexible than the body of the paddle member 10, thereby providing additional gripping of the interior of a paint roller 60 when it is inserted therein.

Figure 9:
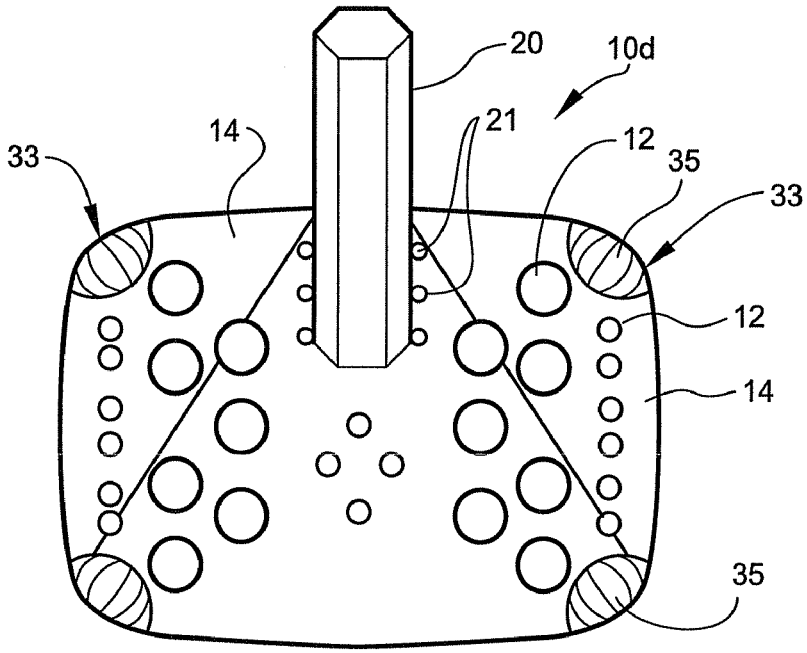
FIG. 9 is a front view of a farther embodiment of the painting implement where the paddle is rigidly attached to the shaft and the paddle has corners with substantially spherical surfaces.

While the majority of embodiments disclosed herein have a paddle member 10 that is rotatably mounted to a rod shaft 20, an alternative embodiment shown in FIG. 9 provides a paddle member 10*d* that is rigidly mounted to a rod shaft 20, typically by welding. By way of example, the rod shaft 20 may have a slot (not shown) extending along its axis from its distal end toward its proximal end, within which the paddle member 10*d* is received. The paddle member 10 is secured to the rod shaft 20 with a series of welds 21 on both sides thereof. This rigidly mounted embodiment is most likely used when the paddle member 10*d* is very large for use in mixing a viscous liquid in a large container. In this embodiment, the upper corners 33 of the paddle may not have the cut-off corners of the rotatable embodiments, but all embodiments are provided with the upper portions of the paddle member 14 oppositely deflected, as described in relation to the first embodiment.

Figure 9A:
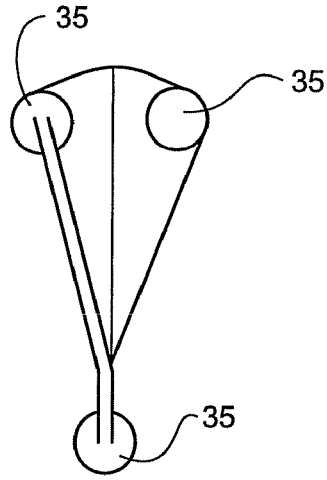
FIG. 9A is a side view of the paddle of the embodiment of FIG. 9.

An additional feature that may optionally be present in any of the embodiments described above is the inclusion of a substantially spherical surface 35 on any or all of the corners of the paddle that are not cut off at an angle (FIGS. 9 and 9A). This spherical surface 35 serves to minimize scraping of the sides of a paint can or bucket by the inventive implement. The spherical surface may be formed either by casting it along with the paddle member such that the spherical surfaces are unitary with the paddle member, or by adding it subsequently, such as by placing a notched ball bearing, for example, over the corner of the paddle member and securing it thereto. In either case, the round edge must not interfere with the ability of the lower edge of the paddle member to be used as a spatula.

One more optional feature is for the bottom edge 36 (see FIG. 6A) of the paddle member to have a softer feel, or be more flexible than the rest of the paddle member, to aid in the ability of the paddle member to act as a spatula. This softer lower edge can be provided by making the paddle of plastic, with the lower edge made to be more soft and/or flexible than the rest of the paddle member. Alternatively, if the paddle member is made of metal, a softer and/or more flexible material can be mounted along the lower edge of the paddle member, similar to the design of a squeegee.

It would be evident to one of ordinary skill in the art that the implement 100 of the present invention may be formed in a variety of ways, including extrusions and injection molding, of a variety of materials, and metals and polymers, and in a variety of material weights, from light for paints, to heavy for thicker fluids, such as sheet rock compound.

It is to be understood that the present invention is not limited to the embodiments described above, but encompasses any and all embodiments within the scope of the following claims.

The invention claimed is:

1. An implement for stirring a fluid substance in a container comprising:

a shaft having a proximal end, a distal end, and a longitudinal axis, said proximal end configured for attachment to an external rotary drive means, a paddle attached to said distal end of said shaft, said paddle having two opposite faces, a thickness, an upper edge, a lower edge, two side edges, two upper corners, and two lowers corners, each of the two upper corners being deflected from the plane of the rest of the paddle, each of the two upper corners being deflected respectively toward opposite sides of said paddle from each other such that, as said paddle rotates around said shaft, the deflected upper corners precede the face of the paddle, thereby increasing agitation in the fluid substance being stirred, said paddle comprising a plurality of apertures formed through the thickness thereof, wherein at least one of said apertures is of a different size from at least another one of said apertures, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, further comprising structure for limiting the degree of rotation of said paddle relative to said shaft such that said paddle cannot rotate to a position where the lower edge of said paddle is parallel to the longitudinal axis of the shaft, and wherein said structure for limiting the degree of rotation comprises a raised projection on said paddle and a notch extending into a side of the shaft near said distal end of said shaft, said notch having an open end and a closed, far end, and wherein rotation of said paddle is limited by said projection reaching said far end of said notch.

2. An implement for stirring a fluid substance in a container, as defined in claim 1, wherein a lower portion extending along said lower edge of said paddle is more flexible than the rest of the paddle to improve the ability of the paddle to function as a spatula and remove said fluid substance from said container.

3. An implement for stirring a fluid substance in a container, as defined in claim 1, wherein said paddle is wider between its upper edge and lower edge proximate a midpoint of each of said upper and lower edges than it is proximate each of the side edges whereby gripping by said paddle of a paint roller which may be received thereover is facilitated.

4. An implement for stirring a fluid substance in a container, comprising:

a shaft having a proximal end, a distal end, and a longitudinal axis, said proximal end configured for attachment to an external rotary drive means, a paddle attached to said distal end of said shaft, said paddle having two opposite faces, a thickness, an upper edge, a lower edge, two side edges, two upper corners, and two lowers corners, each of the two upper corners being deflected from the plane of the rest of the paddle, each of the two upper corners being deflected respectively toward opposite sides of said paddle from each other such that, as said paddle rotates around said shaft, the deflected upper corners precede the face of the paddle, thereby increasing agitation in the fluid substance being stirred, said paddle comprising a plurality of apertures formed through the thickness thereof, wherein said shaft has a substantially polygonal cross-section, along its length, a distal portion of said shaft having approximately half of its cross-section cut away to present a planar face positioned substantially along the longitudinal axis of said shaft, and wherein said paddle is mounted against said planar face so that it is positioned approximately on said longitudinal axis of said shaft for improved balance of said implement during rotation of said implement.

5. An implement for stirring a fluid substance in a container, as defined in claim 4, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, wherein said paddle is wider between its upper edge and lower edge proximate a midpoint of each of said upper and lower edges than it is proximate each of the side edges whereby gripping by said paddle of a paint roller which may be received thereover is facilitated.

6. An implement for stirring a fluid substance in a container, as defined in claim 4, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, further comprising structure for limiting the degree of rotation of said paddle relative to said shaft such that said paddle cannot rotate to a position where the lower edge of said paddle is parallel to the longitudinal axis of the shaft, wherein said structure for limiting the degree of rotation is one of said deflections of said paddle in combination with the shape of the shaft, wherein rotation of said paddle is limited by the shaft interfering with said one of said deflections.

7. An implement for stirring a fluid substance in a container, as defined in claim 4, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, further comprising structure for limiting the degree of rotation of said paddle relative to said shaft such that said paddle cannot rotate to a position where the lower edge of said paddle is parallel to the longitudinal axis of the shaft, wherein said structure for limiting the degree of rotation comprises a raised projection on said paddle and a notch extending into a side of the shaft near said distal end of said shaft, said notch having an open end and a closed, far end, and wherein rotation of said paddle is limited by said projection reaching said far end of said notch.

8. An implement for stirring a fluid substance in a container, as defined in claim 4, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, further comprising structure for limiting the degree of rotation of said paddle relative to said shaft such that said paddle cannot rotate to a position where the lower edge of said paddle is parallel to the longitudinal axis of the shaft, wherein said structure for limiting the degree of rotation comprises a raised projection formed on a side of said shaft and an arched channel formed on one face of said paddle, said channel having two ends, said raised projection sliding within said channel, and wherein rotation of said paddle is limited by said raised projection reaching one or the other of said ends of said channel.

9. An implement for stirring a fluid substance in a container, as defined in claim 4, wherein a lower portion extending along said lower edge of said paddle is more flexible than the rest of the paddle to improve the ability of the paddle to function as a spatula and remove said fluid substance from said container.

10. An implement for stirring a fluid substance in a container, comprising a shaft having a proximal end, a distal end, and a longitudinal axis, said proximal end configured for attachment to an external rotary drive means, a paddle attached to said distal end of said shaft, said paddle having two opposite faces, a thickness, an upper edge, a lower edge, two side edges, two upper corners, and two lowers corners, each of the two upper corners being deflected from the plane of the rest of the paddle, each of the two upper corners being deflected respectively toward opposite sides of said paddle from each other such that, as said paddle rotates around said shaft, the deflected upper corners precede the face of the paddle, thereby increasing agitation in the fluid substance being stirred, said paddle comprising a plurality of apertures formed through the thickness thereof, wherein at least one of said apertures is of a different size from at least another one of said apertures, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, further comprising structure for limiting the degree of rotation of said paddle relative to said shaft such that said paddle cannot rotate to a position where the lower edge of said paddle is parallel to the longitudinal axis of the shaft, wherein said structure for limiting the degree of rotation comprises a raised projection formed on a side of said shaft and an arched channel formed on one face of said paddle, said channel having two ends, said raised projection sliding within said channel, and wherein rotation of said paddle is limited by said raised projection reaching one or the other of said ends of said channel.

11. An implement for stirring a fluid substance in a container, as defined in claim 10, wherein a lower portion extending along said lower edge of said paddle is more flexible than the rest of the paddle to improve the ability of the paddle to function as a spatula and remove said fluid substance from said container.

12. An implement for stirring a fluid substance in a container, as defined in claim 10, wherein said paddle is wider between its upper edge and lower edge proximate a midpoint of each of said upper and lower edges than it is proximate each of the side edges whereby gripping by said paddle of a paint roller which may be received thereover is facilitated.

13. An implement for stirring a fluid substance in a container, comprising:

a shaft having a proximal end, a distal end, and a longitudinal axis, said proximal end configured for attachment to an external rotary drive means, a paddle attached to said distal end of said shaft, said paddle having two opposite faces, a thickness, an upper edge, a lower edge, two side edges, two upper corners, and two lowers corners, each of the two upper corners being deflected from the plane of the rest of the paddle, each of the two upper corners being deflected respectively toward opposite sides of said paddle from each other such that, as said paddle rotates around said shaft, the deflected upper corners precede the face of the paddle, thereby increasing agitation in the fluid substance being stirred, said paddle comprising a plurality of apertures formed through the thickness thereof, wherein at least one of said two upper corners and two lower corners has a substantially spherical surface designed to minimize scraping of the sides of a container in which it is used.

14. An implement for stirring a fluid substance in a container, as defined in claim 13, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, wherein said paddle is wider between its upper edge and lower edge proximate a midpoint of each of said upper and lower edges than it is proximate each of the side edges whereby gripping by said paddle of a paint roller which may be received thereover is facilitated.

15. An implement for stirring a fluid substance in a container, as defined in claim 13, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, further comprising structure for limiting the degree of rotation of said paddle relative to said shaft such that said paddle cannot rotate to a position where the lower edge of said paddle is parallel to the longitudinal axis of the shaft, wherein said structure for limiting the degree of rotation is one of said deflections of said paddle in combination with the shape of the shaft, wherein rotation of said paddle is limited by the shaft interfering with said one of said deflections.

16. An implement for stirring a fluid substance in a container, as defined in claim 13, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, further comprising structure for limiting the degree of rotation of said paddle relative to said shaft such that said paddle cannot rotate to a position where the lower edge of said paddle is parallel to the longitudinal axis of the shaft, wherein said structure for limiting the degree of rotation comprises a raised projection on said paddle and a notch extending into a side of the shaft near said distal end of said shaft, said notch having an open end and a closed, far end, and wherein rotation of said paddle is limited by said projection reaching said far end of said notch.

17. An implement for stirring a fluid substance in a container, as defined in claim 13, wherein said paddle is pivotably attached to said distal end of said shaft, whereby said paddle can pivot between a first position wherein said lower edge of said paddle is substantially perpendicular to said longitudinal axis of said shaft and a second position wherein said side edges of said paddle are almost perpendicular to said longitudinal axis of said shaft, said first position being suitable for mixing said fluid substance in said container, and said second position being suitable for receiving a paint roller over said paddle such that rotation of the shaft about its longitudinal axis will serve to clean the roller, further comprising structure for limiting the degree of rotation of said paddle relative to said shaft such that said paddle cannot rotate to a position where the lower edge of said paddle is parallel to the longitudinal axis of the shaft, wherein said structure for limiting the degree of rotation comprises a raised projection formed on a side of said shaft and an arched channel formed on one face of said paddle, said channel having two ends, said raised projection sliding within said channel, and wherein rotation of said paddle is limited by said raised projection reaching one or the other of said ends of said channel.

18. An implement for stirring a fluid substance in a container, as defined in claim 13, wherein a lower portion extending along said lower edge of said paddle is more flexible than the rest of the paddle to improve the ability of the paddle to function as a spatula and remove said fluid substance from said container.

* * * * *